US007456376B2

(12) United States Patent
Berthault

(10) Patent No.: US 7,456,376 B2
(45) Date of Patent: Nov. 25, 2008

(54) DISPOSABLE DEVICE FOR PACKAGING AND COOKING IN PARTICULAR CORN GRAINS FOR MAKING POPCORN

(76) Inventor: Francois Berthault, 12, Rue Felix Mazieres, Saint Genis de Saintonge (FR) F-17240

( * ) Notice: Subject to any disclaimer, the term of this patent is extended or adjusted under 35 U.S.C. 154(b) by 609 days.

(21) Appl. No.: 10/530,891

(22) PCT Filed: Oct. 3, 2003

(86) PCT No.: PCT/FR03/50076

§ 371 (c)(1),
(2), (4) Date: Apr. 11, 2005

(87) PCT Pub. No.: WO2004/032633

PCT Pub. Date: Apr. 22, 2004

(65) Prior Publication Data

US 2005/0271774 A1 Dec. 8, 2005

(30) Foreign Application Priority Data

Oct. 9, 2002 (FR) ..... 02 12546

(51) Int. Cl.
*H05B 6/80* (2006.01)
*B65D 81/34* (2006.01)

(52) U.S. Cl. ..... 219/727; 219/732; 426/107; 426/113; 426/234; 99/DIG. 14

(58) Field of Classification Search ..... 219/727, 219/725, 730, 732, 734, 735, 762; 426/107, 426/109, 113, 234, 241, 243; 99/DIG. 14
See application file for complete search history.

(56) References Cited

U.S. PATENT DOCUMENTS

| | | | | |
|---|---|---|---|---|
| 2,791,367 | A | | 5/1957 | Mefford |
| 4,038,425 | A | * | 7/1977 | Brandberg et al. ..... 426/107 |
| 4,453,665 | A | | 6/1984 | Scott et al. |
| 5,097,107 | A | * | 3/1992 | Watkins et al. ..... 219/727 |
| 5,358,175 | A | | 10/1994 | Cai |
| 5,468,939 | A | | 11/1995 | MacLean |

FOREIGN PATENT DOCUMENTS

| | | |
|---|---|---|
| DE | 19643837 | 5/1995 |
| EP | 0563442 | 10/1993 |
| FR | 2699150 | 6/1994 |
| JP | 7-291367 | * 11/1995 |
| WO | 91/15096 | 10/1991 |

* cited by examiner

*Primary Examiner*—Philip H Leung
(74) *Attorney, Agent, or Firm*—Young & Thompson

(57) ABSTRACT

A device for the display and cooking of kernels of corn for making popcorn, includes a container with a base that can store kernels of corn and a compensating zone that can take up at least two positions, one folded and the other unfolded.

11 Claims, 5 Drawing Sheets

Figure 1A:
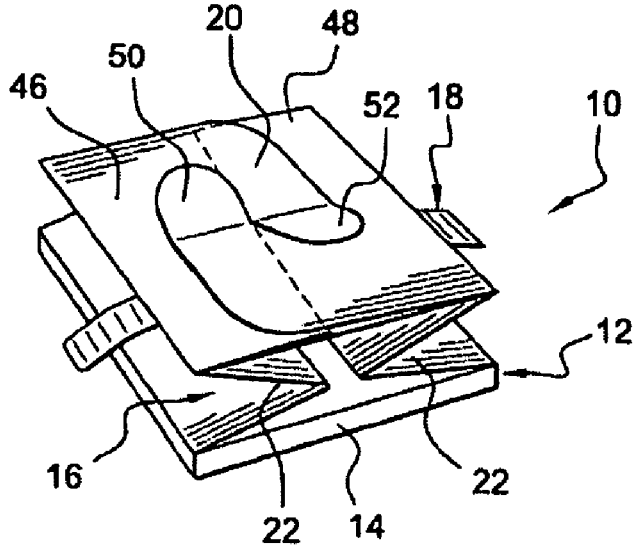

DISPOSABLE DEVICE FOR PACKAGING AND COOKING IN PARTICULAR CORN GRAINS FOR MAKING POPCORN

This invention relates to a single-serving device for the display and cooking of in particular kernels of corn for making popcorn.

This invention is described with regard to a well-known product, popcorn, but it is possible to consider other applications, in particular appetizers such as snacks of any kind, balls, fried or made from corn semolina converted into semolina and compressed and prepared in a suitable way.

For reasons of simplifying the explanation and taking into account the fact that the device is in all cases used in a totally identical way, the description is given for the natural corn kernel and the production of popcorn.

It has been known for a long time that corn kernels, when heated, burst by forming a white corolla, whereby the product is referred to as popcorn.

These kernels of corn should be placed in a container in the presence of grease.

With the invention of the microwave oven, however, the manufacturers proposed corn kernels packaged in bags with grease immobilizing the corn kernels under cold conditions because the grease congeals.

Actually, to ensure an efficient popping that is as complete as possible, it was preferable that the corn kernels remain pressed against one another. Radiation was then concentrated, and efficiency was increased.

The corn kernels themselves are different only in that they are used with thermal heating or with microwave heating. There is no need for a special prior treatment. The water that is contained in the kernels that is converted into vapor causes the explosion of the kernel shell and the formation of popcorn.

In the case of these flexible packages, the bag is made of a material that is suitable for letting microwaves pass through without being degraded under their effects, and this bag is also used as a container. More precisely, the complex comprises at least one microwave-reactive layer that transmits a portion of the microwaves, absorbs another portion of them for conversion into infrared radiation and in contrast reflects the infrared thus produced to reconstitute the heating conditions that are adequate for causing the kernels to pop. In contrast, after cooking, the bag remains very hot because of the very small thickness of the package and the heat that is generated.

Once the kernels have popped, in the case of sweetened popcorn if it is desired to convert the sugars and obtain the organoleptic properties produced by the Maillard reactions that provide the taste of caramel from sugar, it is necessary to reach an adequate temperature, which makes such a package difficult to create.

More particularly, a product of this type is known under the name Crousti Pack.

For the consumer, it takes only placing the package in the microwave oven, putting the latter into operation for the recommended period, and taking out the container with its popcorn ready to be eaten.

It is the swelling of the popcorn and the generation of steam with the expansion of the contained air that ensure the swelling and the unfolding of the bag that initially contains the corn kernels.

Since then, it is known that microwave ovens have been improved and that the radiation is homogeneous and that it is no longer necessary to pack the kernels against one another.

In contrast, there exists a problem that relates to the display because once unfolded, the bag that is made of a complex of plastic and/or paper films does not have any stability and it cannot be used as a display container. As indicated above, the bag remains extremely hot after the popcorn is produced.

In contrast, it is also understood that the initial package should of necessity be folded to reduce its volume. The kernels could move in a container that was much too large before cooking, which is not desirable and, moreover, it is not possible to transport packages that are 9/10 empty. It is necessary that they be folded.

A foldable box for cooking popcorn is described in the document U.S. Pat. No. 5,468,938. This parallelepipedic box comprises lateral walls with automatic assembly flaps. In flat position, the rear and front faces are flattened against the bottom and top faces. To form the box, it takes only pushing the opposing edges toward one another. The corn kernels are packaged in a bag that can be introduced into the box.

This solution is not satisfactory because the bag is not immobilized in the folded box and prevents a complete folding of the box.

Also, this invention proposes a new device that makes it possible to use and to preserve corn kernels, to carry out the popping of these kernels in a microwave oven and to display the popcorn that is produced.

To this end, this invention has as its object a device for the display and cooking of corn kernels for making popcorn, characterized in that it comprises a container with a base that can store the corn kernels and a compensating zone that can take up at least two positions, one folded and the other unfolded.

Figure 1B:
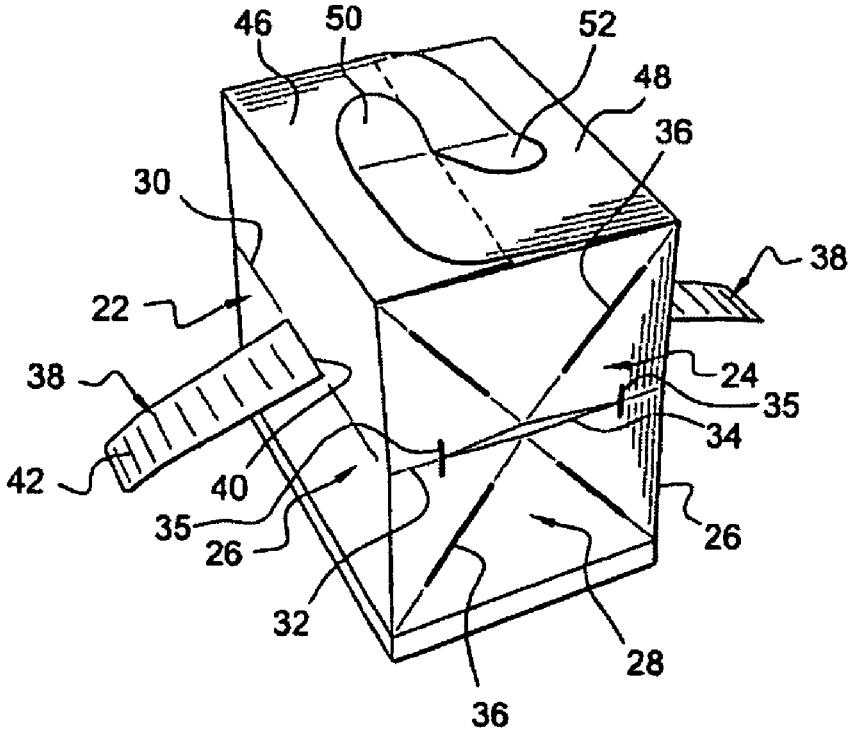
Figure 2:
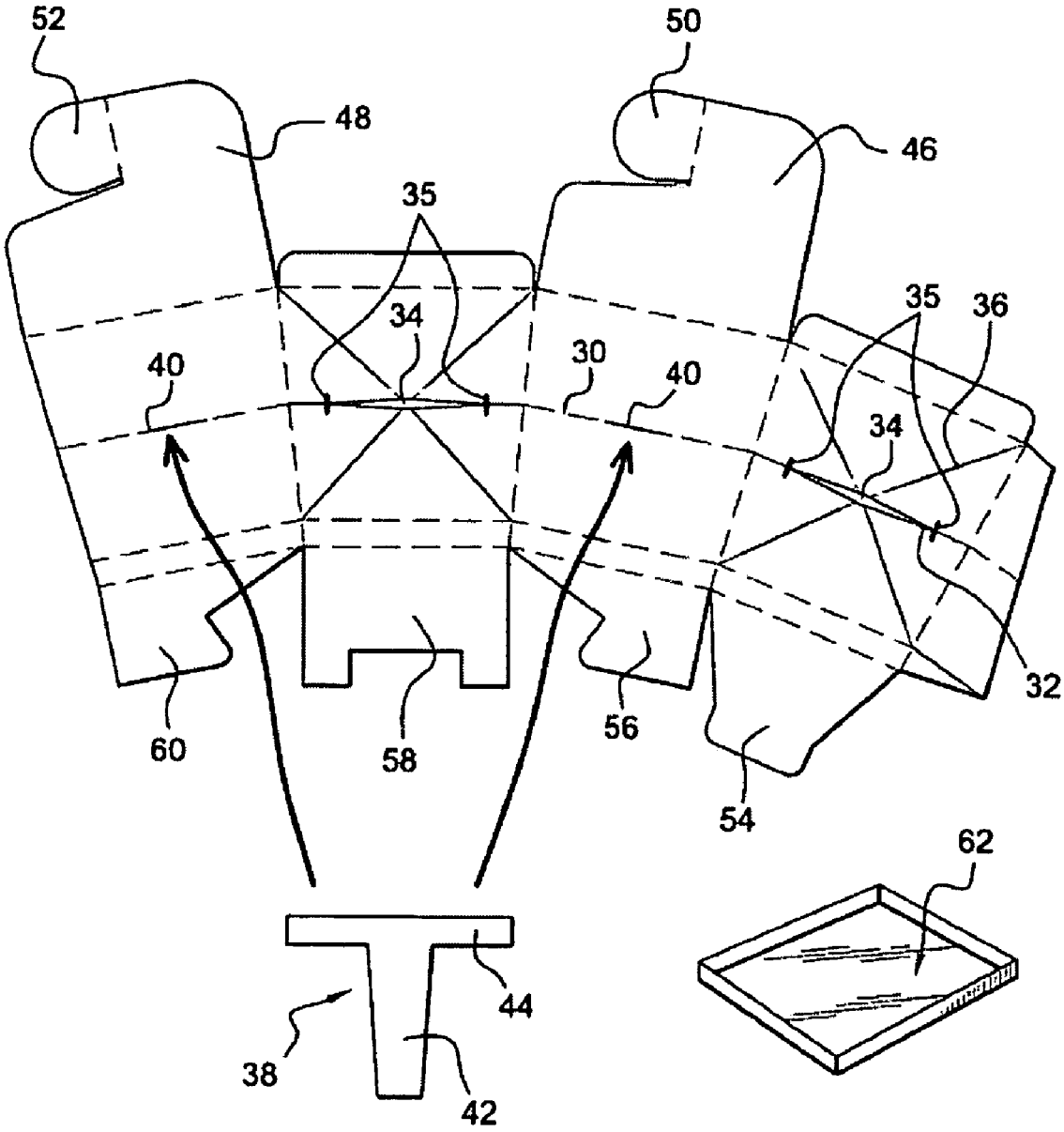
Figure 3:
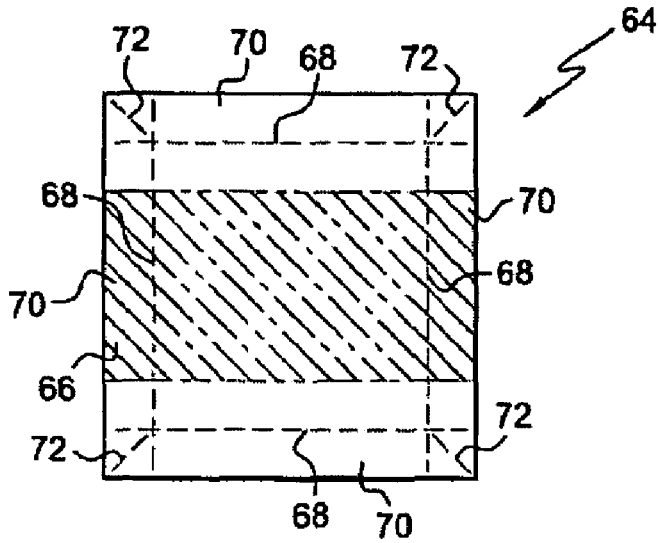
Figure 4:
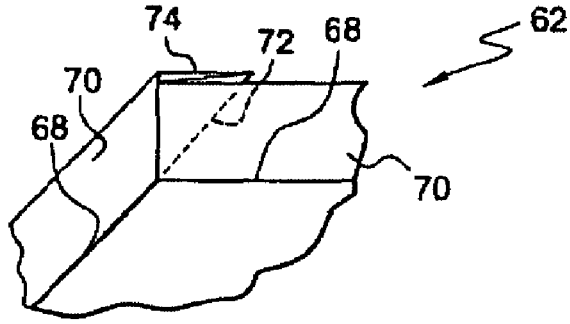
Figure 5:
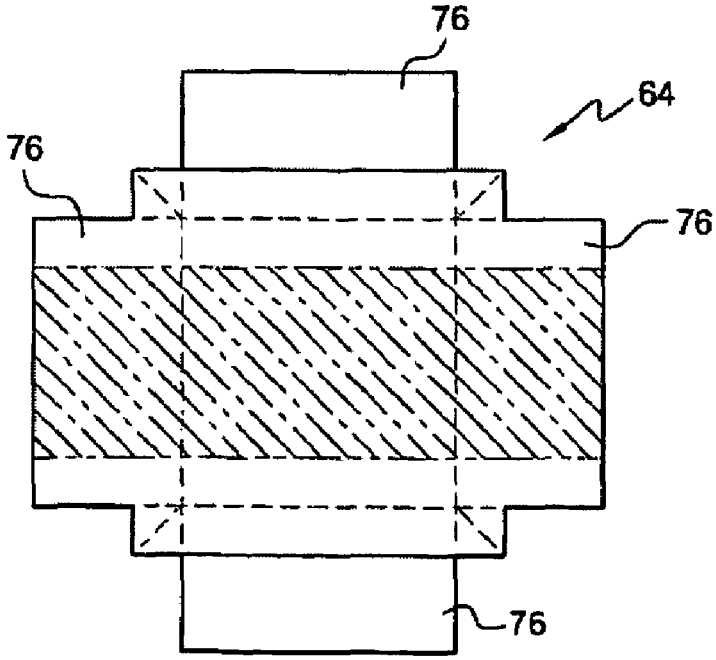
Figure 6A:
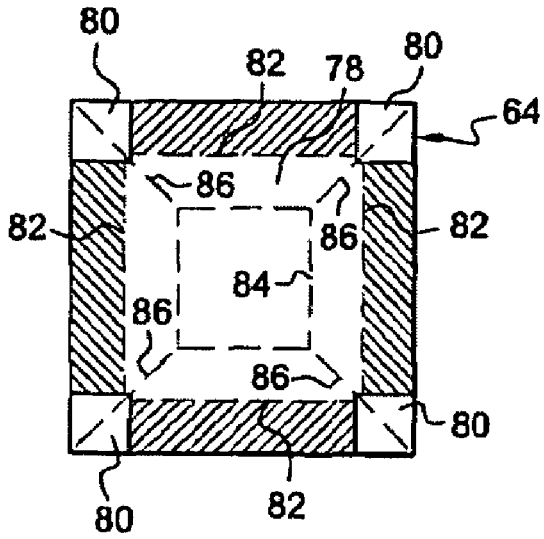
Figure 6B:
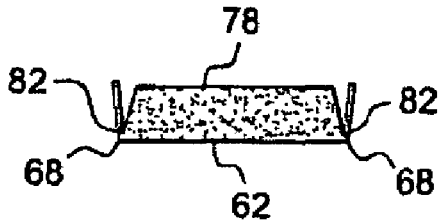
Figure 7A:
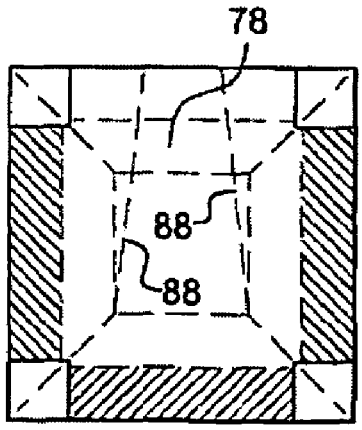
Figure 7B:
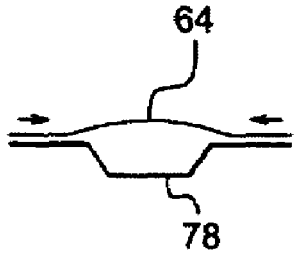
Figure 8A:
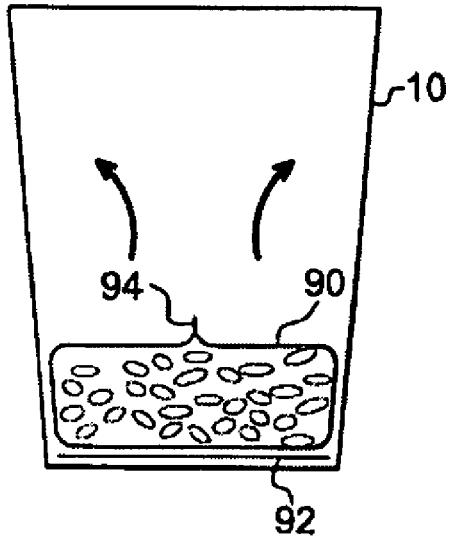
Figure 8B:
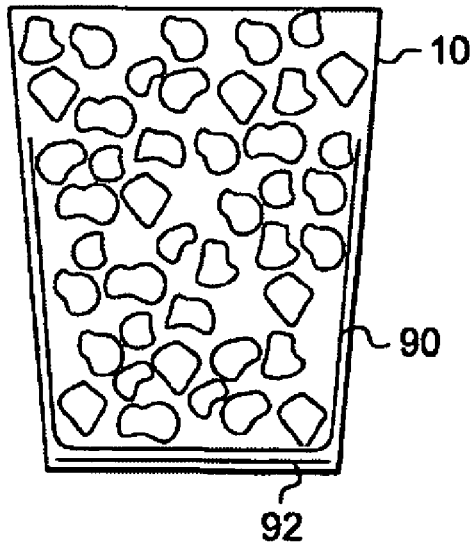

This invention is described in detail with regard to the accompanying drawings that show a preferred but no limiting embodiment, whereby the figures correspond to FIG. 1A, a view of the device for the display and cooking of kernels of corn according to this invention, in the folded position, FIG. 1B, a view of this same device after unfolding, ready for cooking, FIG. 2, a view of the mold making it possible to produce such a device, FIG. 3, a view illustrating an embodiment of a mold that forms the tub, FIG. 4, a perspective view in detail of an angle of a tub, FIG. 5, a view illustrating another embodiment of a mold, FIG. 6A, a view that provides a flat illustration of a tub with a cover according to a first embodiment, FIG. 6B, a section showing the tub of FIG. 6A that is formed, FIG. 7A, a view that provides a flat illustration of a tub with a cover according to another embodiment that makes it easy to fill, FIG. 7B, a top view that shows the tub of FIG. 7B in filling position, and FIGS. 8A and 8B, sections of another method of packaging corn kernels before and after cooking.

In FIG. 1A, device 10 comprises a container 12 with a base 14, a compensating zone 16, unfolding means 18, and means 20 for opening/closing this container.

The unit is preferably made from a board-type material, more particularly a virgin-wood-fiber cardboard to preserve food quality.

The base is rectangular or square in shape and rigid and is on the order of 1 to 2 centimeters high to set forth the concept.

This base is intended to accommodate the raw corn kernels. The volume of kernels determines the amount of popcorn that will be produced. Nevertheless, it is understood that a small thickness is necessary because the microwave penetration capacity in food is low, on the order of 2 cm. It therefore is necessary to limit the base to this small height to obtain the greatest efficiency.

To increase the volume, it is suitable to vary the other dimensions.

The compensating zone is folded in FIG. 1A, but with an unfolding initiator so as to be able to distinguish the different parts. In reality, the height of the unit seems to be essentially the same as that of the height of the base.

This compensating zone comprises folds 22 and 24, respectively located on the faces opposite said retractable faces 26 and stiffening faces 28.

Retractable faces 26 each comprise a fold 30, obtained by grooving the board-type material, whereby this fold is approximately in the middle of each of the faces and parallel to the base.

Stiffening faces 28 each comprise several folds, a first fold 32 in the continuity of folds 30, placed in the median plane. In contrast, each fold 32 is also obtained by grooving, but comprises in the central portion a cutaway 34 that makes it possible to form a diamond-shaped window, with an opening that can vary during unfolding operations, as will be indicated below. Cutaway 34 is linear and optionally comprises additions to facilitate this opening. Advantageously, cutaway 34 can comprise at each end a cutaway 35 that extends in an approximately perpendicular manner to cutaway 34, on both sides of said cutaway 34 so as to prevent the box from tearing in the extension of cutaway 34.

In addition, 36 diagonal folds, also produced by grooving, are provided.

Thus obtained is a bellows with rigid, foldable walls.

Unfolding means 18 comprise two tabs 38, one per retractable face 26. As shown in FIG. 2, each tab is advantageously T-shaped. A slit 40 is located in each fold 30, whereby said slit has a length that allows the passage of the longitudinal branch 42 of the T and prevents the passage of transverse branch 44. In this embodiment that is presented, the assembly is simple and purely mechanical.

The transverse branch is optionally affixed directly to this retractable face 26, but on the outside.

Means 20 for opening/closing this container comprise two flaps 46, 48 that can be folded back and that are each provided with a clip 50, 52. Each clip can immobilize the opposite flap to ensure that flaps are locked in the closing position of the container.

Bottom 52 of the container is formed, in a way known in box-making, by four flaps 54-60 being arranged alternately on top of one another.

To be certain that the corn kernels are well enclosed without the risk of passing through these flaps that are arranged alternately on top of one another, a tub 62, shown in FIG. 2, is provided.

This tub is also made of a material that absorbs the energy that is transported by the microwaves and that can generate infrared radiation that can trigger the Maillard reactions when these are kernels with sugars. In the case of corn kernels that are salted or buttered, no conversion occurs, but the energy that is absorbed improves the popping.

To preserve the corn kernels with the hygrometric degree necessary for popping thereof, generally on the order of 14%, it is necessary to place the device under a suitable complex film. This protective complex is opened at the time of use as for any other food product of this type.

The use of this device for the display and cooking of corn kernels to make popcorn thereof is now indicated.

The consumer withdraws from its package the device, which is in folded form with corn kernels immobilized in the base, in tub 62, if present. The base makes it possible to store the kernels and to immobilize them in a restricted space. The presence of the base also makes it possible to obtain a complete folding of compensating zone 16 contrary to the devices of the prior art. The consumer pulls on the two tabs 38 so as to remove the two retractable faces 26, at right angles with each fold 30, which has the effect of unfolding these two faces, removing base 14 from closing means 20 and simultaneously unfolding stiffening faces 28. Window 34 closes to no more than a slit, and these stiffening faces become essentially planar. Cutaway 34 that forms the window promotes the unfolding of compensating zone 16 and reduces the deterioration of the edges connecting faces 26 and 28. This cutaway 34 is even necessary when faces 26 and 28 are trapezoidal to create a box shaped like an upside-down truncated pyramid.

The microwave oven is put into operation for the recommended period, which causes the popping of the corn kernels and the conversion of sugars.

The device is then filled with popcorn that is ready to eat.

The volume of the container is established based on the volume of kernels initially contained in the base.

The consumer can use tabs 38 to handle the device without being burned.

When he is ready, the consumer opens two flaps 46, 48 by removing two clips 50, 52 to dig into the interior.

It is noted that the container is stable, rigid and makes it possible not only to store it before use in a compact form and to cook it, but also to display it, without it being necessary to tear or cut a bag with the concomitant risks of spilling the entire contents.

An additional significant advantage that solves the problem of residual heat is that the slits located in the different faces make possible an evacuation of the steam and prevent the concentration of this residual heat.

It is also noted that it is possible to reclose two flaps 46 and 48 to preserve the remaining popcorn for the purpose of later consumption.

Such a device is industrially advantageous for its simple production.

Actually, the device according to the invention is completely rigid by itself.

The folding, the filling and the packaging of the device according to this invention can be easily automated.

Cardboard was mentioned because it is a particularly suitable material, but it would be possible to use a synthesis material, one of the conditions being to exhibit a certain rigidity.

Likewise, the presented shape has constant dimensions in height, but the container can be shaped like an upside-down truncated pyramid.

According to an improved version, flaps 46 and 48 can be made detachable with pre-scoring to ensure that it opens fully and freely.

In FIGS. 3, 4, 5, 6A, 6B, 7A and 7B, various embodiments of tub 62 are shown.

According to a first embodiment, the tub is obtained from a quadrilateral-shaped mold 64 that preferably consists of a paper- or cardboard-based multilayer structure that is coated with at least one metalized sheet 66, indicated by dashes, that can absorb the energy that is transported by microwaves.

Mold 64 comprises four folding lines 68, each parallel to an edge of mold 64, delimiting flaps 70 that can form the lateral walls of the tub. Folding lines 68 delimit in the center the bottom of the tub whose dimensions are adapted to base 14.

At the level of each angle, a folding line 72 is provided that connects each angle of the mold and the corresponding point of intersection of folding lines 68 to allow the folding of the lateral walls of the tub. Preferably, excess thickness zones 74, produced by the folding of lateral walls at each angle, are folded back against the outside faces of said lateral walls, as illustrated in detail in FIG. 4, so as to form a trough that flows in the direction of the inside of tub 62 to limit the leakage of grease outside of said tub 62.

Preferably, as illustrated in FIG. 3, metalized sheet 66 is placed between two parallel folding lines 68 to keep metalized zones from coming into contact at corners and to limit heating risks.

According to another characteristic of the invention, as illustrated by FIG. 5, flaps 70 that form the lateral walls of the tub each comprise an extension 76 that can cover a portion or the entirety of the inside walls of box 10 so as to reduce the risks of contact of the grease with the walls of said box 10.

According to another characteristic, the tub comprises an element that forms a cover to isolate the food products, either in the form of a film or in the form of a covering sheet 78 that is made of cardboard or a semi-rigid material and that is connected to the lateral walls of small container 62 with a seam or glue that is preferably thermosetting, as illustrated in FIGS. 6A, 6B, 7A and 7B.

Advantageously, covering sheet 78 is cross-shaped and comprises offsets 80 so as not to cover the angle zones of mold 64 and to prevent excess thicknesses in this folding zone. Sheet 78 preferably comprises first folding lines 82 that are parallel to folding lines 68, slightly offset toward the outside to facilitate the shaping of tub 62.

Covering sheet 78 advantageously comprises second folding lines that make it possible to obtain a volume that can contain food products, as illustrated in FIG. 6B. The second folding lines make it possible to obtain a truncated pyramid shape and comprise folding lines that delimit a square 84 and diagonal folding lines 86 connecting each peak of said square to the angle of corresponding offset 80.

According to another characteristic of the invention, illustrated by FIGS. 7A and 7B, covering sheet 78 comprises third folding lines 88, not parallel to first folding lines 82, forming a truncated triangle with one of the sides of square 84. When the opposing sides of tub 62 are pulled together, these folding lines 88 make it possible to create a pour funnel as illustrated in FIG. 7B.

Of course, the embodiment of FIGS. 6A and 6B can comprise extensions 78 as illustrated in FIG. 5 and/or a metalized sheet 66 as illustrated in FIG. 3.

In FIGS. 8A and 8B, another method for packaging food products was shown. This packaging method comprises a packet 90 that rests on a sheet 92, made of a material that is identical to that of mold 64, covering the bottom of the box. Packet 90 comprises seam lines, one 94 oriented upward, which are thermosetting at the temperature at which popcorn is cooked, so that they open during cooking and flatten against the inside walls of the box to reduce the risk of the walls of said box 10 coming into contact with the grease, as illustrated in FIG. 8B.

The invention claimed is:

1. A device for the display and cooking of corn kernels for making popcorn, comprising:

a rigid base (14), a compensating zone(16) that can take up at least two positions, one folded and the other unfolded, the compensating zone comprising four faces, two retractable faces (26) opposite two stiffening faces (28), whereby retractable faces (26) each comprise a fold (30) that is approximately in the middle of each of these faces and parallel to the base and whereby stiffening faces (28) each comprise a first fold (32), placed in the median plane, and diagonal folds (36);

means (20) for opening and closing a container by expanding the compensating zone; and the rigid base (14) of a limited height in order to delimit a restricted space in which are stored the corn kernels when the compensating zone is in the folded position, wherein said base (14), said compensating zone (16) and said means (20) for opening and closing are made of one piece of material with a certain rigidity in the manner of a cardboard material.

2. The device for the display and cooking of corn kernels according to claim 1, wherein first fold (32) of stiffening faces (28) comprises a cutaway (34) of the central portion that can form a window with an opening that can vary.

3. The device for the display and cooking of corn kernels according to claim 1, wherein it comprises means (18) for unfolding with two tabs (38), one per a retractable face (26) of said retractable faces.

4. The device for the display and cooking of corn kernels according to claim 3, wherein each tab (38) is affixed against an outside wall of each retractable face (26).

5. The device for the display and cooking of corn kernels according to claim 1, wherein the opening and closing means (20) comprise two flaps (46, 48) that can be folded back and are each equipped with a clip (50, 52).

6. The device for the display and cooking of corn kernels according to claim 1, wherein the container is made of cardboard.

7. The device for the display and cooking of corn kernels according to claim 1, wherein it comprises a tub (62) inserted into base (14).

8. The device for the display and cooking of corn kernels according to claim 7, wherein tub (62) that is made from a folded mold (64) comprises a metalization sheet (66) that does not cover the zones of the mold that are brought into contact with one another because of folding.

9. The device for the display and cooking of corn kernels according to claim 7, further comprises:

wherein lateral walls (70) of the tub comprises extensions (76) that can cover a portion or the entirety of inside walls of the container.

10. The device for the display and cooking of corn kernels according to claim 7, wherein the tub comprises an element that forms a cover to isolate the food products, whether in the form of a film or in the form of a covering sheet (78) that is made of cardboard or a semi-rigid material, connected to the lateral walls of small container (62) with a seam or glue that is thermosetting.

11. The device for the display and cooking of corn kernels according to claim 1, wherein the rigid base (14) of a limited height is one to two centimeters in height.

* * * * *